US006079907A

United States Patent [19]

Valero Ruiz et al.

[11] Patent Number: 6,079,907

[45] Date of Patent: Jun. 27, 2000

[54] REINFORCEMENTS AND A REINFORCEMENT SYSTEM FOR STABILIZED EARTH

[75] Inventors: Faustino Valero Ruiz; Lorenzo Muzas Labad; Jose Amed Rego Castellanos; David Ortega Vidal, all of Madrid, Spain

[73] Assignee: Sistemas S.R.S., S.L., Madrid, Spain

[21] Appl. No.: 08/860,409

[22] PCT Filed: Oct. 31, 1996

[86] PCT No.: PCT/ES96/00205

§ 371 Date: Aug. 13, 1997

§ 102(e) Date: Aug. 13, 1997

[87] PCT Pub. No.: WO97/17498

PCT Pub. Date: May 15, 1997

[30] Foreign Application Priority Data

Nov. 3, 1995 [ES] Spain ..... 9502144

[51] Int. Cl.[7] ..... E02D 17/20

[52] U.S. Cl. ..... 405/259.1; 405/258

[58] Field of Search ..... 405/231, 339, 405/244, 249, 250, 251, 252, 252.1, 254, 256, 258, 259.1, 262

[56] References Cited

U.S. PATENT DOCUMENTS

| | | | |
|---|---|---|---|
| 1,270,659 | 6/1918 | Ravier | 405/262 |
| 1,792,333 | 2/1931 | Takechi | 405/256 |
| 4,239,419 | 12/1980 | Gillen, Jr. | 405/252 |
| 4,411,557 | 10/1983 | Booth | 405/262 |
| 4,649,729 | 3/1987 | McDowell et al. | 405/259.1 |
| 4,955,758 | 9/1990 | Hyde | 405/259.1 |

FOREIGN PATENT DOCUMENTS

| | | |
|---|---|---|
| 1173383 | 2/1959 | France . |
| 2368583 | 5/1978 | France . |
| 2753224 | 6/1979 | Germany . |
| 1069361 | 5/1967 | United Kingdom . |
| 9312312 | 6/1993 | WIPO . |

*Primary Examiner*—Eileen Dunn Lillis
*Assistant Examiner*—Frederick L. Lagman
*Attorney, Agent, or Firm*—Ladas & Parry

[57] ABSTRACT

New armatures and system using them, applicable to reinforced or armored masses of earth, which present a non planar section, with surrounding retainers having improved technical characteristics of traction resistance and friction surfaces.

19 Claims, 7 Drawing Sheets

REINFORCEMENTS AND A REINFORCEMENT SYSTEM FOR STABILIZED EARTH

The present invention relates to improvements to or in connection with reinforcements for use in stabilized or framed earth masses.

PRIOR ART

The technique of stabilizing earth masses by incorporation of flexible reinforcements in the mass itself is in general use throughout the world, and at the present time the basic theoretical principles of its operation are known fairly accurately, these principles having been originally established in British Patent No 1069361 of Henri Vidal, which is now in the public domain, and being briefly summarized below in order to provide a complete statement of the invention.

A mass of natural, unstabilized ground has a potential sliding or fracturing surface, which was initially established by Coulomb as a plane and which, usually passing through the foot of the outer surface of the mass, forms an angle dependent on the internal angle of friction of the ground, with a value of approximately 63° in relation to the horizontal for ground habitually used for this type of construction. Other forms of sliding surface, of circular and generally curvilinear development, are closer to reality. In all cases ground situated on this surface is called an "active wedge".

The fixing of this "active wedge" by means of a resistant front face is what concerns the construction of traditional walls. Fastening it by joining to the ground at the rear, from a front face of lower resistance, is what constitutes the anchored wall technique.

The inclusion of reinforcements distributed in the ground of the mass modifies the characteristics of the latter, so that the boundary of the "active wedge" is situated substantially nearer the outer boundary surface of the mass, with an inclined plane development at the base, which becomes vertical from a certain height onwards, to a separation close to 0.3 H from said outer surface, H being the mechanical height of the mass. Numerous trials and actual measurements made in the last 20 years for the different reinforcement methods employed confirm that the boundary of the "active zone" practically coincides with the position of the maximum tensions in the reinforcement elements. This means that the inclusion of reinforcements distributed in the ground modifies and improves the behaviour of the ground by giving it a certain anisotropy.

These principles have given rise to numerous methods of reinforcement consisting of a more or less light, deformable face, from which reinforcement elements extend towards the ground to be stabilized, in such a manner as to pass across the boundary of the "active zone" and extend over a sufficient length—the "resistant zone"—for the frictional forces of the reinforcement elements relative to the ground to exceed the maximum tension values developed in them (see FIG. 1). It is found that these frictional forces do not develop in a useful manner beyond a distance of 0.8 H of the face, even with low values of H, with the exception of special cases in respect of load and/or configuration of the slope on the mass.

The friction capacity of each reinforcement element is obviously dependent on the useful length behind the "active zone", on the pressure which the ground exerts on its surface, on the area of contact and on the nature of the surface material of the element, which is translated into the coefficient of friction between said material and the ground.

The reinforcements are generally incorporated in the earthwork in successive layers, over which extends a certain thickness of ground, which is compacted and over which is laid the following layer of reinforcements, this pattern being repeated until the total height of the mass is reached. The whole arrangement must be sufficiently stable to support the thrust of the ground at the rear and the thrust of the loads acting on it, with the safety coefficients required.

With these methods, and in a general way, in order to ensure sufficient frictional interaction of the reinforcement elements, it is convenient for a minimum of some 2%, and preferably some 5%, of the area of the stratum of earth on which each layer of reinforcements is laid to be covered with the material of which the latter are made, and for at least four reinforcement levels to be provided.

The tensile strength of the reinforcements must thus on the one hand be sufficient to withstand the horizontal forces caused by the thrust of the ground and the loads acting on the latter, a certain flexibility of said reinforcements being convenient in order to permit adaptation to the movements of the reinforced mass, while their properties are retained. This requirement is dependent on the tensile strength of the material of which the reinforcements are made and on the area of the latter, and is a determinant factor in the neighbourhood of the line of maximum tensions.

On the other hand, the reinforcements must provide for the ground a sufficient area of contact to mobilize frictional forces capable of balancing the maximum tension over a reasonable length. The requirement in the "resistant zone" is therefore the total area in contact and therefore the perimeter of the section of the reinforcements and length, the area of said zone not being a determinant factor.

It is in the achievement of this compromise that the improvements and perfections of the reinforcement elements have been developed, because the reduction of the length of the reinforcements, without increasing their number, reduces the required volume of the fill selected and therefore the cost of the construction work.

The frameworks or reinforcements were originally in the form of bands, in which the perimeter:area ratio reaches the highest values, this step forward corresponding to British Patent No 1069361, in which use was made of thin metal bands of a length greater than 0.7 H, with uniform characteristics over their entire length.

A first improvement in the initial process is evidently the use of bands having a different width in the "resistant zone", which is difficult to apply in practice.

One way of reducing the resistant length while maintaining the area presented would be to increase the value of the coefficient of friction between the ground and the material of the bands, by means of corrugations, fluting or ribbing of slight height in the horizontal surfaces of the bands, this process being within the scope of British Patent No 1563317.

In Patent Application PCT WO-95/11351 a distinction is made between the two functions of the bands, concentrating requirements in respect of section by means of concentrated cores of resistant material, to which are integrally added either other, lighter, less expensive material in order to obtain the required surface of the band with an improved finish, or plane lateral extensions of the same material.

In Patent No 2014562 a shortening of the length of the mass to less than 0.65 H is achieved, while the same number of reinforcement bands is retained, by bifurcation of the bands in the last third of the latter, that is to say doubling the surface presented to the ground in part of the "resistant zone".

To sum up, all the processes consist of an increase of the resistance to extraction of the bands by means of improvements of the coefficient of friction or enlargement of the surface presented by the bands to the ground fill, at least in the "resistant zone", in order thus to stabilize the frontal "active zone".

In any case, as the patents themselves show: "The area of reinforcement in contact with the earthwork is calculated so as to ensure that the reinforcements cannot be extracted by pulling".

The difference and the advantage of the present invention is clear. With the same increase of material, the application of the patent ES 452262, by means of the formation of ribs on the bands, does not achieve any increase of frictional surface but solely and exclusively an improvement of the coefficient of friction between the bands and the ground. Patent Application WO-95/11351 also does not create any frictional surface additional to that of the side wings, but on the contrary considerably increases the cost of material additional to the core.

DESCRIPTION OF THE INVENTION

In the present invention flexible reinforcements are presented for ground stabilization, which, as is natural for this purpose, are equipped with a front end for anchoring by conventional methods to the elements constituting the outside skin or face, and whose functioning in respect of resistance and friction is distinguished as follows:

A) Its resistant section (FIG. 2, 1) is not determined by perimeter requirements, so that compact, non-plane shapes can be used with a low perimeter:area ratio, including hollow configurations in which said ratio relates to the external perimeter.

B) Requirements in respect of friction are met by providing the compact resistant section with retaining modules (FIG. 2, 2), which surround it and which are so spaced that the surface in frictional contact with the ground is formed by a cylinder or prism, having a straight generatrix, of the ground itself (FIG. 2, 3) and confined between the retaining elements, in such a manner that the perimeter is the exterior of the retaining elements (FIG. 3, D) and the coefficient of friction is that corresponding to ground-to-ground, that is to say the maximum attainable.

The materials of which these reinforcements can be made are preferably metallic, preferably based on iron or steel. A variant contemplated in the present invention is that the material of the reinforcement is composed, entirely (core plus retaining modules) or partially (core or retaining modules), on the basis of polymeric material. Another preferred embodiment of the invention is for the core and/or retaining elements to be formed from cement material, for example concrete. For these purposes the material of which the core of the reinforcement is made and that of the retaining modules need not be the same. That is to say, the scope of protection of the present invention includes combinations: metallic core-retaining modules of polymeric material, or vice versa. The same type of combinations would apply in the case of concrete.

The results of the trials carried out in the laboratory indicate that, if the height of the retaining elements is greater than 3 mm and provided that their spacing does not exceed 60 times their height, the extraction responds to the ground breaking point values on the surface of the assembly comprising the reinforcement-ground cylinder, the residual value responding to the ground-ground coefficient of friction, thus achieving the qualification of the reinforcements as "high adhesion" in the general technique of Reinforced or Framed Grounds (FIG. 4). According to these tests the reinforcements forming the subject of the present invention comply with all the requirements for high adhesion reinforcements, with pairs of values all above the line (2).

The advantage in comparison with the prior art is undoubted, because it becomes possible to comply with requirements for reinforcements in respect of friction, without any preconditions whatsoever with regard to their tension-resistant section, through the addition of a small amount of material, which may be the same as or different from that of the resistant section, thus making it possible to take advantage of the shear resistance characteristics of the ground itself.

Thus, as particular examples of embodiment of the invention and more concretely for circular cylindrical configurations, we can cite by way of illustration, and without any limitative character, the details shown in the following table.

TABLE I

| D. Core mm | D. Retaining elements mm | Δ Material: Cost % | Δ Frictional area % |
|---|---|---|---|
| 8 | 14 | 7 | 75 |
| 12 | 22 | 10 | 83 |
| 16 | 26 | 8 | 62 |

in each case with an improved coefficient of friction.

Although there are no great differences in the tensional stress on the reinforcements in comparison with other reinforcements described in the prior art, since this depends solely on the nature of the material and the resistant area, the gain in friction is clearly advantageous in comparison with high-adhesion reinforcement bands having the same area, as is shown in the illustrative examples, which do not have a limitative character, shown in the following table.

TABLE II

| D. Core mm | D. Retaining elements mm | Δ Frictional surface: material ratio % |
|---|---|---|
| 8 | 14 | 115 |
| 8 | 18 | 142 |
| 16 | 26 | 43 |

In view of the fact that the different standards which exist for the dimensioning of Reinforced or Framed Grounds require over-thickness representing a sacrifice to corrosion, the advantage of the reinforcements of the invention is impressive in providing compact sections having a low perimeter:area ratio, which will always entail a higher useful area:total area ratio than with plane reinforcements or bands, and this in turn permits the use of greater thicknesses which are economically prohibitive for the latter.

As will be appreciated, with this type of reinforcements the latter can be shorter than the usual uniform reinforcements which have the same resistant section and of which the same number are used, and it will be possible to use a smaller number of them or to use a smaller section for one and the same length. In addition, because of the advantages indicated above there is nothing to prevent the manufacture of reinforcements having a low unit weight, so that requirements in respect of resistance can be met gradually and accurately. In any case, the result will be a considerable saving, either in the volume of fill required or in the actual cost of the reinforcement material.

Comparative calculations made for one and the same mass, with an overload of 1 t/m$^2$ and an internal angle of friction of 30°, equipped with plain bands, ribbed bands and reinforcements according to the invention, produce the following results:

TABLE III

| Mechanical m | H.L. Reinforcement m | Plain band kg/m$^2$ | Ribbed band kg/m$^2$ | Reinforcement according to the invention kg/m$^2$ |
|---|---|---|---|---|
| 6 | 4.5 | 18 | 13.25 | 9 |
| 12 | 9 | 32 | 25 | 19 |

The invention is applicable to masses of all heights, since it is possible to adapt the section to requirements in respect of resistance and to adapt the dimensions of the retaining elements to requirements in respect of friction.

None of the general indications of present processes, in respect of the need for a certain ratio between the area of the ground bed on which each layer of reinforcements to be covered is laid and the material of the reinforcements, applies to the process of the invention.

The drawings show illustrative but not limitative embodiments of the present invention. Both the section of the core of the reinforcement and the contour of the retaining elements may be regular (parallelepiped, triangle, circle, ellipse, hexagon, etc.) or irregular. The retaining elements may or may not be arranged to surround the core of the reinforcement, or be spaced, helical, offset subdivided into 2 complementary parts, inclined relative to the perpendicular to the axis of the core, thickened, spike-like, etc. They may also have contours provided with bevelled or rounded edges, and these contours may or may not coincide with the section of the core of the reinforcement, that is to say the perimeter of the retaining elements need not be parallel or homothetic to the core (for example: circular core and rectangular or irregular retaining elements, or vice versa).

Their system of fastening to the reinforcement core may consist of any of those described in the known art: adhesive bonding, filler metal or pressure welding, additional casting, production by co-extrusion, simultaneous casting, etc.

Figure 1:
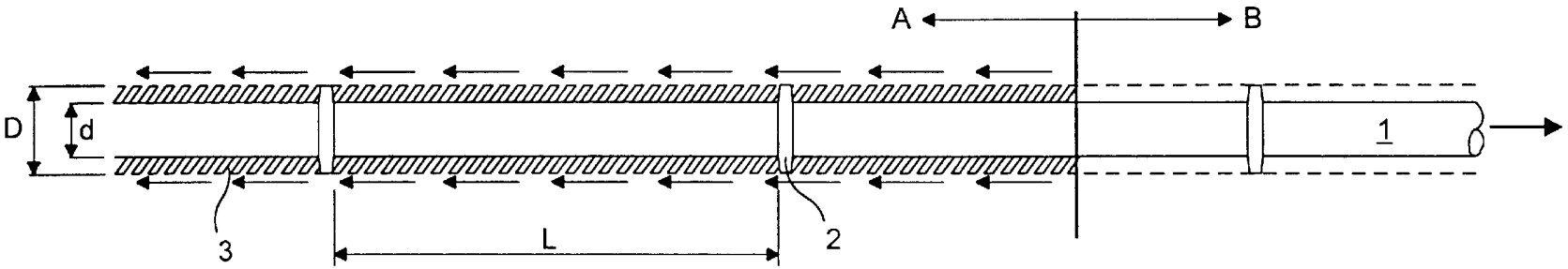
FIG. 1: Resistance diagram in which 1 represents the core of the reinforcement, 2 the retaining module and 3 the mobilized ground. D and d are respectively the width (diameter in the case of circular structures) of the mobilized volume of earth and of the core+the mobilized volume of the reinforcement. A represents the so-called "resistant zone" and B the so-called "active zone", while L is the distance between retaining modules (2).
Figure 2:
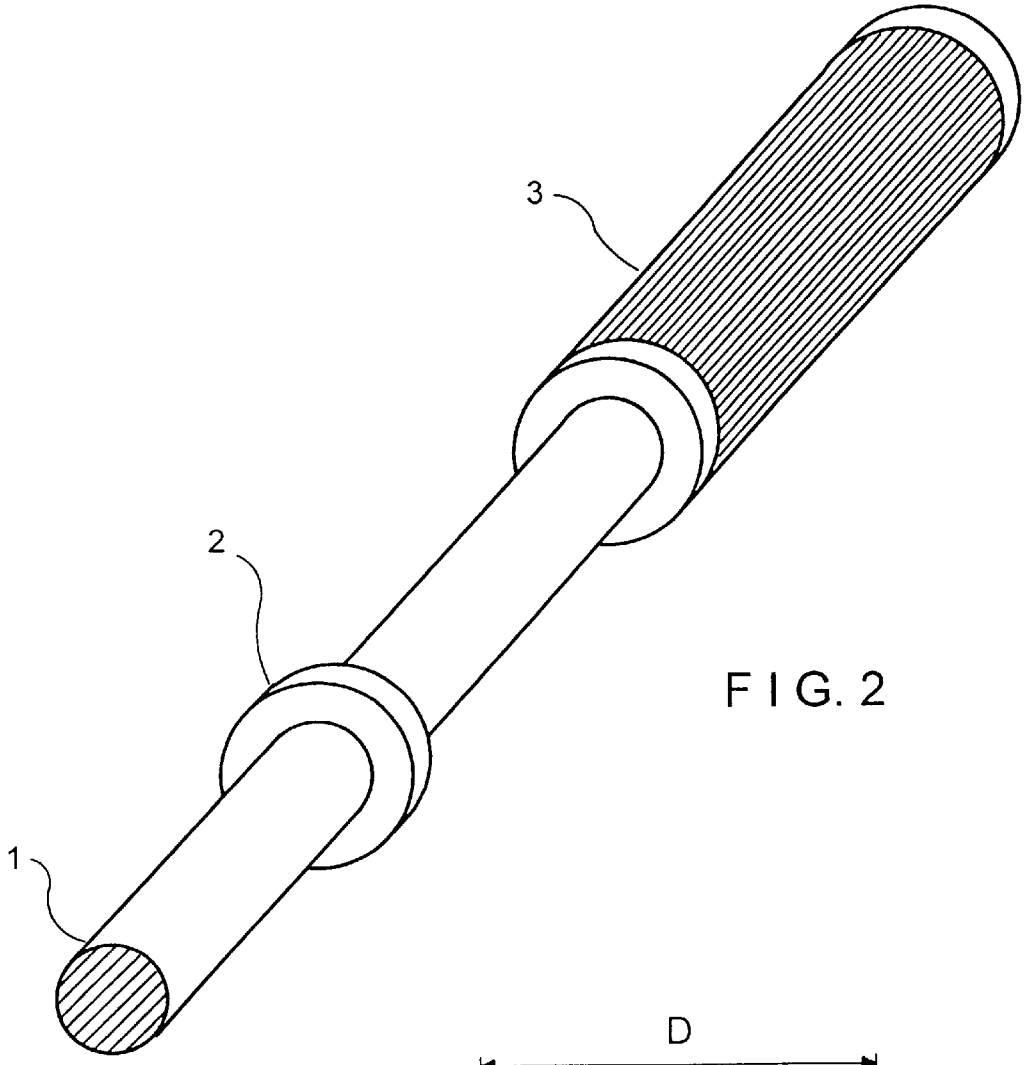
FIG. 2: Three-dimensional representation of a reinforcement composed of the core (1) having a non-plane section and the retaining module or retaining element (2). In the representation it is possible to see the mobilized volume of earth (3) between retaining modules.
Figure 3:
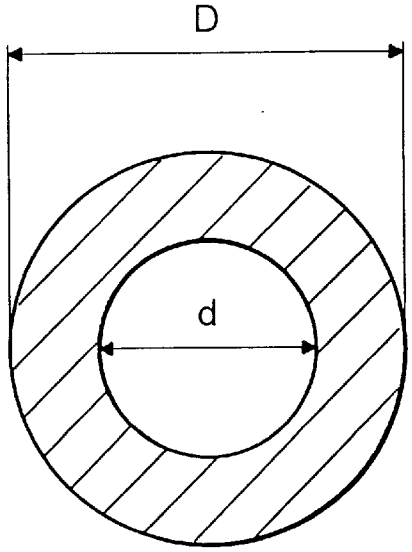
FIG. 3: Section of a retaining module in which d is the diameter of the core and D the diameter of the core+the mobilized volume.
Figure 4:
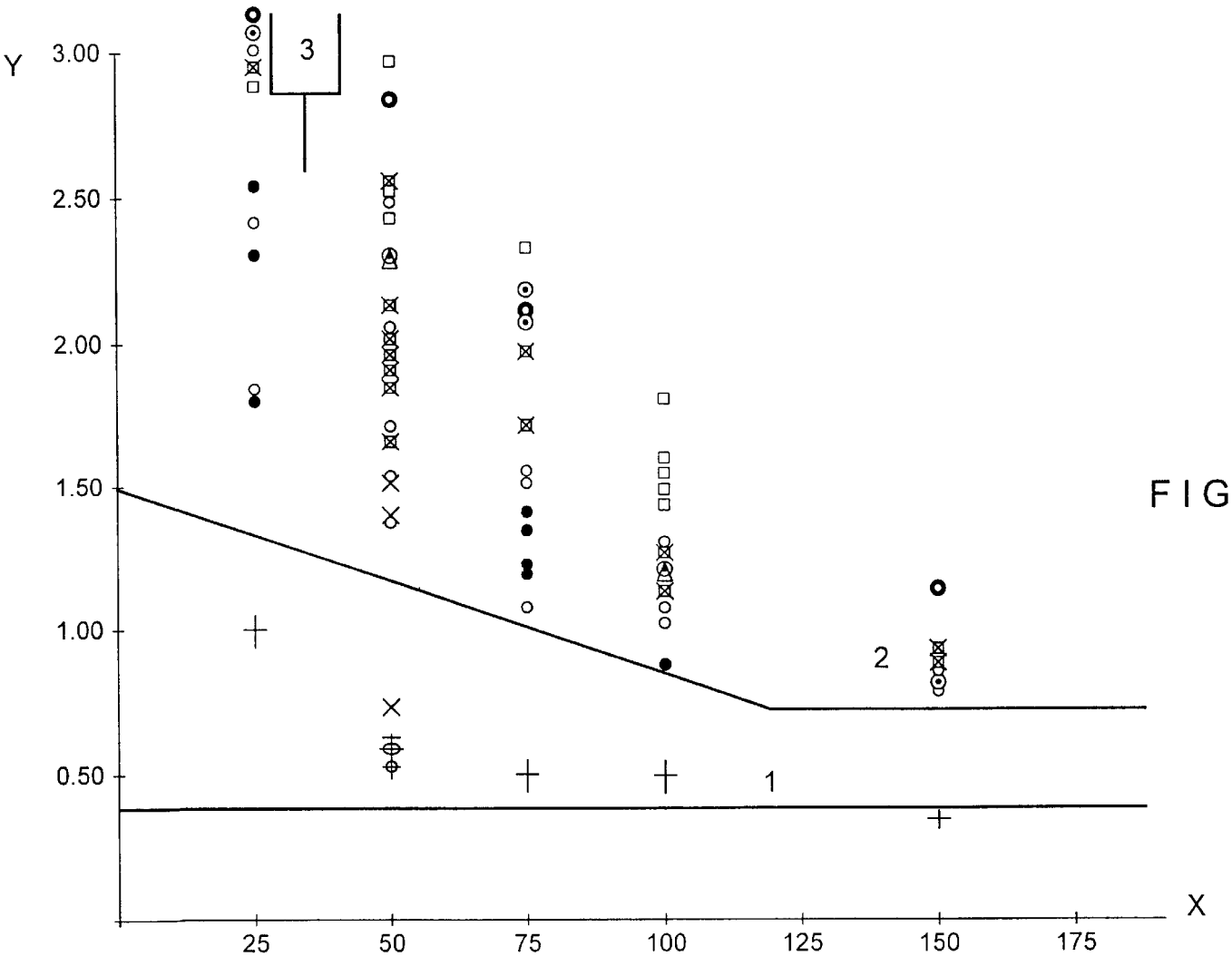
FIG. 4: Representation of the coefficient of friction (Y) plotted against vertical pressure in KN/m$^2$ (X). The line 1 corresponds to plain tie rods and the line 2 to high-adhesion tie rods. At point 3 are shown those pairs of values which are outside the scale represented (>3).
Figure 5:
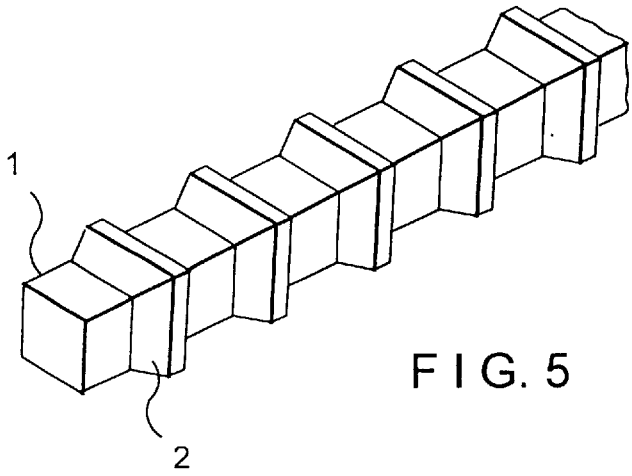
FIG. 5: Reinforcement of solid, square section with retaining elements surrounding the core and having a square contour coinciding with the section, with bevelled edges.
Figure 6:
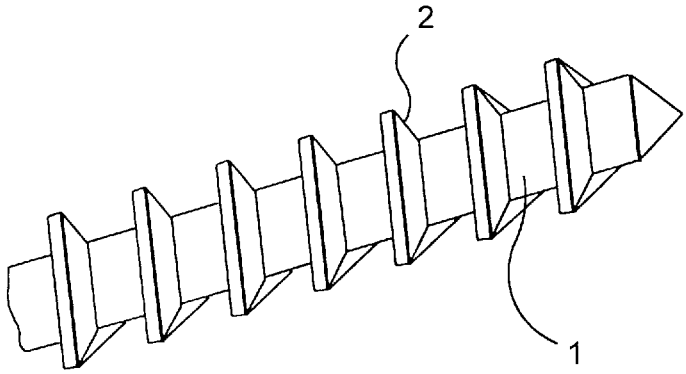
FIG. 6: Reinforcement of solid, triangular section with retaining elements surrounding the core and having a triangular contour coinciding with the section.
Figure 7:
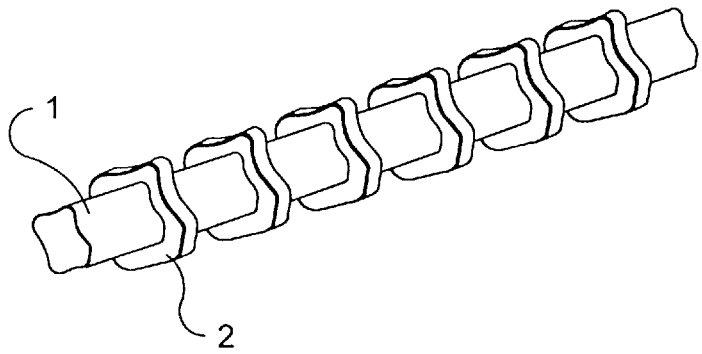
FIG. 7: Reinforcement of solid, irregularly curved section with retaining elements surrounding the core and having an irregularly curved contour coinciding with the section.
Figure 8:
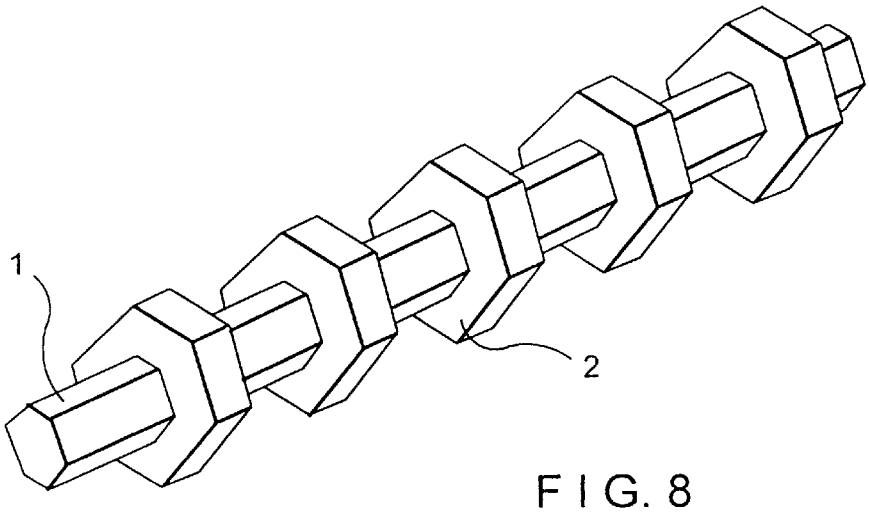
FIG. 8: Reinforcement of solid, hexagonal section with retaining elements surrounding the core and having a hexagonal contour coinciding with the section.
Figure 9:
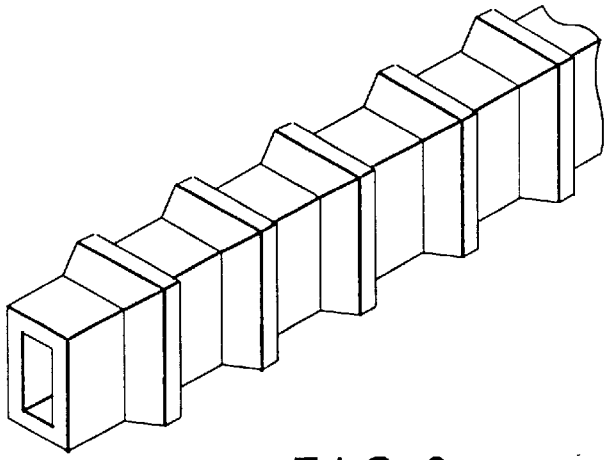
FIG. 9: Reinforcement of hollow, rectangular section with retaining elements surrounding the core and having a rectangular contour coinciding with the section.
Figure 10:
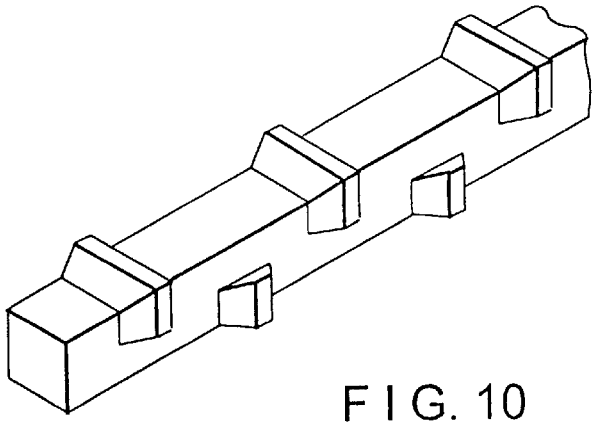
FIG. 10: Reinforcement of solid, square section with offset retaining elements half surrounding the core and having a U-shaped contour forming half-grooves.
Figure 11:
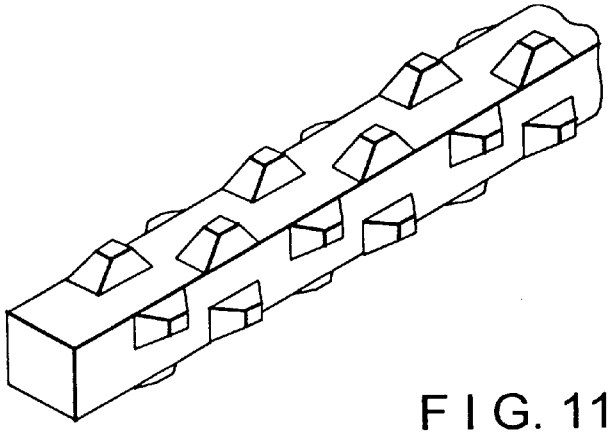
FIG. 11: Reinforcement of solid, square section with tooth-shaped retaining elements.
Figure 12:
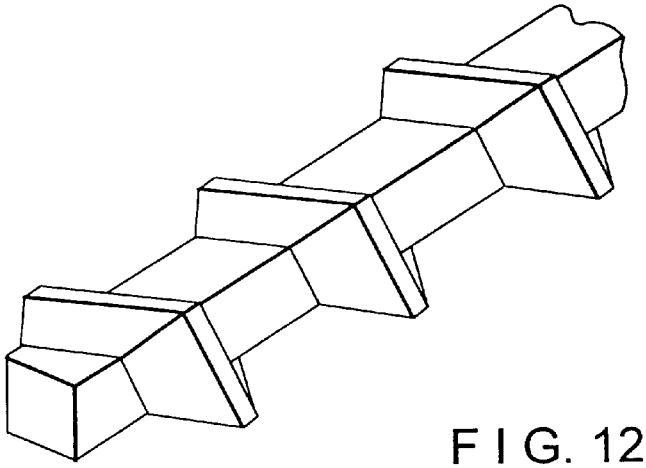
FIG. 12: Reinforcement of solid, square section with retaining elements surrounding the core and in the form of a helicoidal groove.
Figure 13:
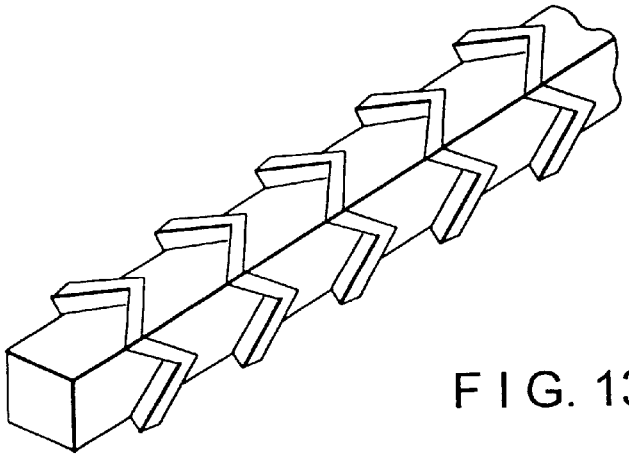
FIG. 13: Reinforcement of solid, square section with retaining elements surrounding the core and in the form of spaced spike-like grooves.
Figure 14:
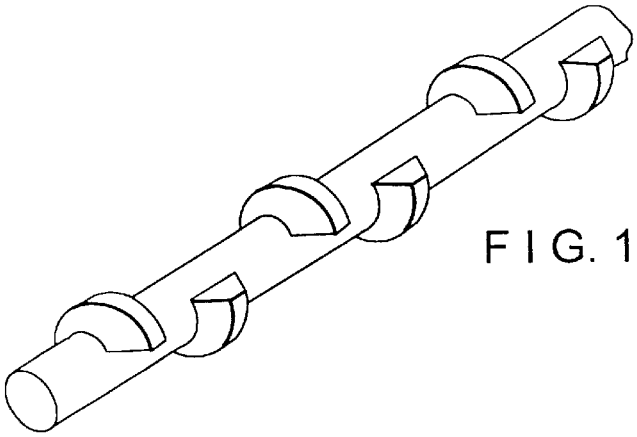
FIG. 14: Reinforcement of solid, circular section with retaining elements in the form of half-rings.
Figure 15:
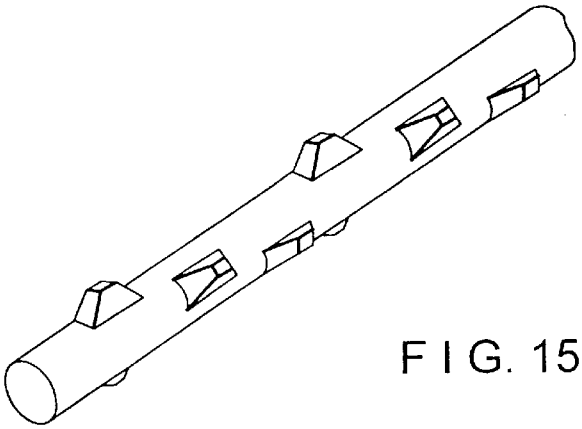
FIG. 15: Reinforcement of solid, circular section with retaining elements in the form of teeth.
Figure 16:
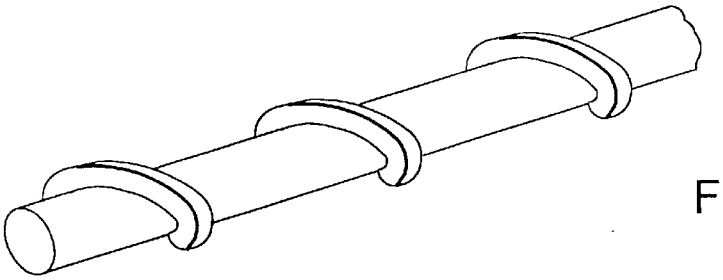
FIG. 16: Reinforcement of solid, circular section with retaining elements surrounding the core and forming a helicoidal ring.
Figure 17:
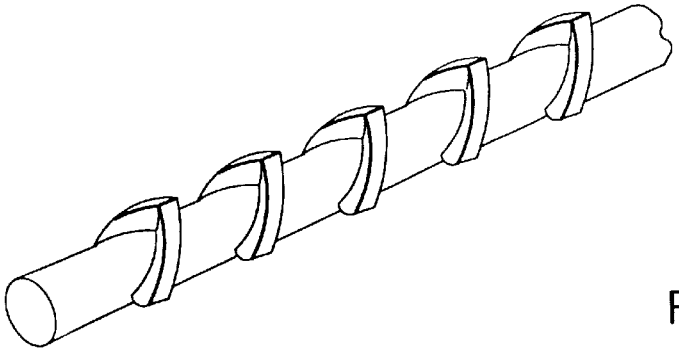
FIG. 17: Reinforcement of solid, circular section with retaining elements surrounding the core and having circular spike-like contours.

What is claimed is:

1. A reinforcement for forming a reinforced or framed mass of earth comprising an elongate core element and a plurality of retaining modules, each of said retaining modules being in contact with and surrounding a discrete portion of the core element with each of the retaining modules spaced from one another, said retaining modules having congruent shapes and protruding from the core element the same height such that, upon insertion of the reinforcement into the mass of earth, at least first and second of the retaining modules confine earth therebetween to form a cylinder or prism with first and second bases comprising said first and second retaining modules respectively and with sides comprising the confined earth, wherein a distance the retaining modules are spaced from one another and the height the retaining modules protrude from the core element are selected such that, upon insertion of the reinforcement into the mass of earth, the reinforcement achieves a coefficient of friction that, when plotted against vertical pressure acting on the reinforcement, is above line 2 of the graph of FIG. 4.

2. A reinforcement for forming a reinforced or framed mass according to claim 1, wherein the retaining modules protrude from the core element a height of at least 3 mm and wherein the space between the retaining modules does not exceed 60 times said height.

3. A reinforcement for forming a reinforced or framed mass according to claim 2, wherein the height that the retaining modules protrude from the core element is between 6–10 mm.

4. A reinforcement for forming a reinforced or framed mass according to claim 1, wherein the core element is hollow.

5. A reinforcement for forming a reinforced or framed mass according to claim 1, wherein the core element is solid.

6. A reinforcement for forming a reinforced or framed mass according to claim 1, wherein the core element and the retaining modules comprise the same material.

7. A reinforcement for forming a reinforced or framed mass according to claim 1, wherein the core element comprises a different material than the retaining modules.

8. A reinforcement for forming a reinforced or framed mass according to claim 1, wherein the core element, the retaining modules or both are metallic.

9. A reinforcement for forming a reinforced or framed mass according to claim 1, wherein the core element, the retaining modules or both are of a polymeric material.

10. A reinforcement for forming a reinforced or framed mass according to claim 1, wherein the core element, the retaining modules or both are cementitious.

11. A reinforcement for forming a reinforced or framed mass according to claim 1, wherein the core element, the retaining modules or both are concrete.

12. A reinforcement for forming a reinforced or framed mass according to claim 1, wherein the core element is metallic and the retaining modules are a polymeric material or vice versa.

13. A reinforcement for forming a reinforced or framed mass according to claim 1, wherein the core element is metallic and the retaining modules are cementitious or vice versa.

14. A reinforcement for forming a reinforced or framed mass according to claim 1, further comprising a face from which the core element extends.

15. A reinforcement for forming a reinforced or framed mass according to claim 1, wherein the retaining modules are circular.

16. A reinforcement for forming a reinforced or framed mass according to claim 1, wherein the retaining modules are polyhedral.

17. A construction system comprising a plurality of reinforcements, including the reinforcement of claim 1.

18. A construction system comprising a plurality of reinforcements, including the reinforcement of claim 14.

19. A combination of the reinforcement of claim 1 and a mass of earth, said reinforcement being inserted in the mass earth and reinforcing or framing it.

* * * * *